United States Patent [19]

Champoux et al.

[11] B 3,996,784

[45] Dec. 14, 1976

[54] SINGLE OPERATION-TRIPLE CYCLE LOCKBOLT SETTING DEVICE AND SYSTEM

[75] Inventors: Louis A. Champoux, Seattle; Hollis B. Merrell, Renton, both of Wash.

[73] Assignee: The Boeing Company, Seattle, Wash.

[22] Filed: Oct. 21, 1974

[21] Appl. No.: 516,537

[44] Published under the second Trial Voluntary Protest Program on February 17, 1976 as document No. B 516,537.

[52] U.S. Cl. ..... 72/391; 72/453.05

[51] Int. Cl.[2] ..... B21J 15/00; B21J 15/22; B21J 15/12

[58] Field of Search ..... 29/243.53, 243.54, 508, 29/509, 517, 526, 520, 243; 72/391, 453; 85/7

[56] References Cited

UNITED STATES PATENTS

| | | | |
|---|---|---|---|
| 3,309,911 | 3/1967 | Simmons | 72/391 |
| 3,475,945 | 11/1969 | Chirco | 72/391 |
| 3,645,125 | 2/1972 | Summerlin | 72/391 |
| 3,698,231 | 10/1972 | Davis | 72/391 |
| 3,792,933 | 2/1974 | Stencel | 72/391 |

*Primary Examiner*—C.W. Lanham
*Assistant Examiner*—Joseph A. Walkowski
*Attorney, Agent, or Firm*—Morris A. Case; Bernard A. Donahue

[57] ABSTRACT

A process for seating a lockbolt with a positioned collar, swaging the collar onto the seated lockbolt and breaking off the pintail all in one operation. A single source of hydraulic power pulls a nose piece with gripper jaws to seat the lockbolt and to break off the pintail, and to move an anvil in the opposite direction to swage a collar onto the seated lockbolt. A combination air and hydraulic system sequences these steps.

13 Claims, 6 Drawing Figures

SINGLE OPERATION-TRIPLE CYCLE LOCKBOLT SETTING DEVICE AND SYSTEM

BACKGROUND OF THE INVENTION

Part joining lockbolts are set by grasping the pintail with gripper jaws and pulling to seat the lockbolt, swaging a collar onto the seated lockbolt and then exerting additional pressure on the pintail to break off same. This setting of the lockbolt is presently accomplished in two steps. First, a lockbolt is inserted through a hole without a collar mounted thereon. The gripper jaws of a setting device grasp the pintail to pull the lockbolt into the seated position. Next, the lockbolt setting device is removed by releasing the gripper jaws, a collar is inserted over the end of the lockbolt and the lockbolt setting device is again positioned to grasp the pintail of the lockbolt. At this time the hydraulic pressure used to actuate the pulling device is manually increased. Pulling on the jaws causes the device to move forward to swage the collar onto the lockbolt with a swaging die. Once the die bottomed out, pulling pressure breaks off the pintail of the lockbolt.

U.S. Pat. No. 3,777,540 by Siebol et al discloses a single operation of setting a lockbolt wherein the collar is swaged in a direction away from the workpiece, and the means for moving the anvil for the swaging, and the means for pulling on the jaws each have a separate hydraulic piston for actuation and a separate hydraulic line for supplying different pressures to these pistons. A single operation system for setting lockbolts was discovered wherein a single hydraulic line will actuate the pulling jaws and will move a swaging anvil in the opposite direction to swage a collar onto a lockbolt in a direction toward the workpiece.

SUMMARY OF THE INVENTION

A pair of pistons are slideably mounted within a housing and are powered by hydraulic fluid under pressure introduced between the two pistons to move said pistons in opposite directions. One of the pistons is connected to a nose piece or gripper jaws for connection to the pintail of a lockbolt. The other piston is connected to an anvil or swaging die to swage a collar onto a seated lockbolt. Hydraulic pressure works simultaneously against the two pistons. An air and hydraulic pressure control system limits the pressure of hydraulic fluid to a pressure sufficient to pull the pintail of a lockbolt to seat same. Once the lockbolt is seated, hydraulic pressure increases to actuate a sequencing valve and to shut off the pressure limiting control. The sequencing valve prevents movement of the piston connected to the swaging die until after the lockbolt has been seated. Once the sequencing valve is actuated, it permits movement of the piston to move the swaging die against the collar to swage the collar against the seated lockbolt. Then the swaging die bottoms out. The pressure builds higher to exert additional force against the piston connected to the pulling jaws to move those jaws and break off the pintail. The housing for the lockbolt setting device has a stand off to permit a collar to be positioned on the lockbolt prior to pulling on the lockbolt to seat same without exerting pressure on the collar. This allows a single operation consisting of three cycles of first, pulling on the pintail with a mounted collar thereon to seat the lockbolt, second, to move the swaging die forward to swage the collar onto the lockbolt, and third, to pull on and to break off the pintail.

It is an object of this invention to provide an apparatus and a method of providing a single operation for setting a lockbolt.

It is another object to sequence pressures from a single hydraulic source to control the steps of setting a lockbolt.

It is another object to provide an apparatus capable of setting a wedge head or a conventional lockbolt in a single operation.

DETAILED DESCRIPTION

Figure 3:
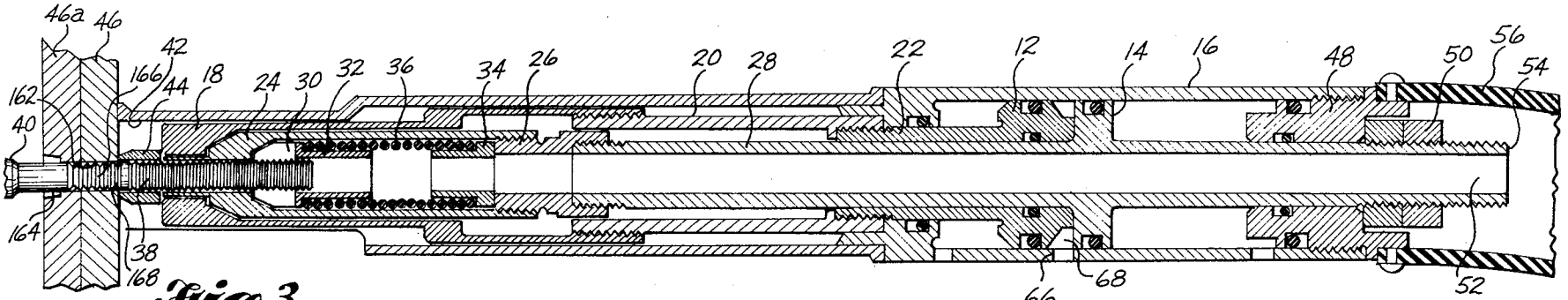
FIG. 3 shows a side elevational sectional view of the barrel only of the lockbolt setting apparatus of FIG. 1 with the apparatus positioned over a lockbolt.
Figure 4:
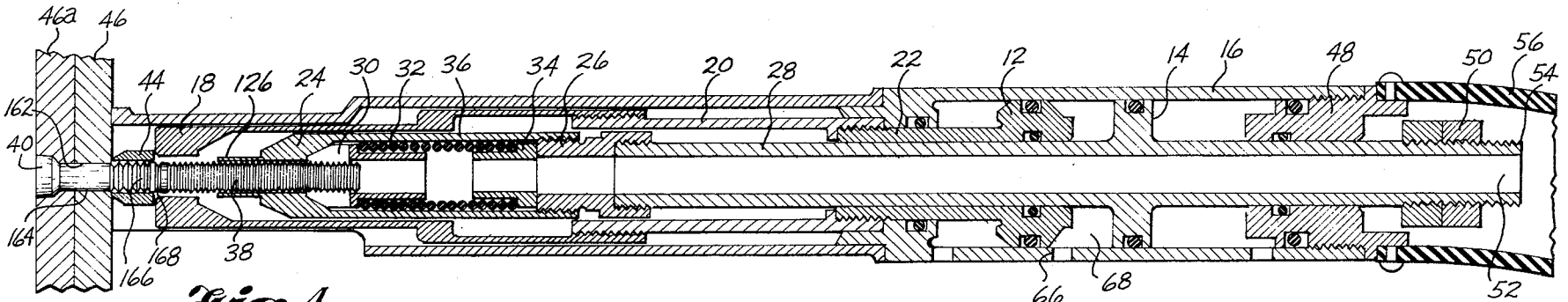
FIG. 4 shows a view as in FIG. 3 with the lockbolt in the seated position.
Figure 5:
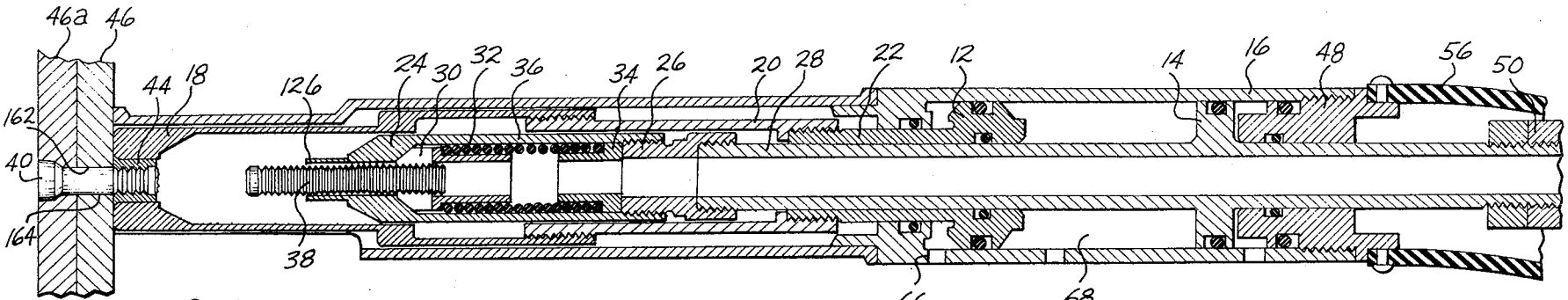
FIG. 5 shows the view as in FIG. 3 with a collar swaged on the seated lockbolt and the pintail broken off.
Figure 6:
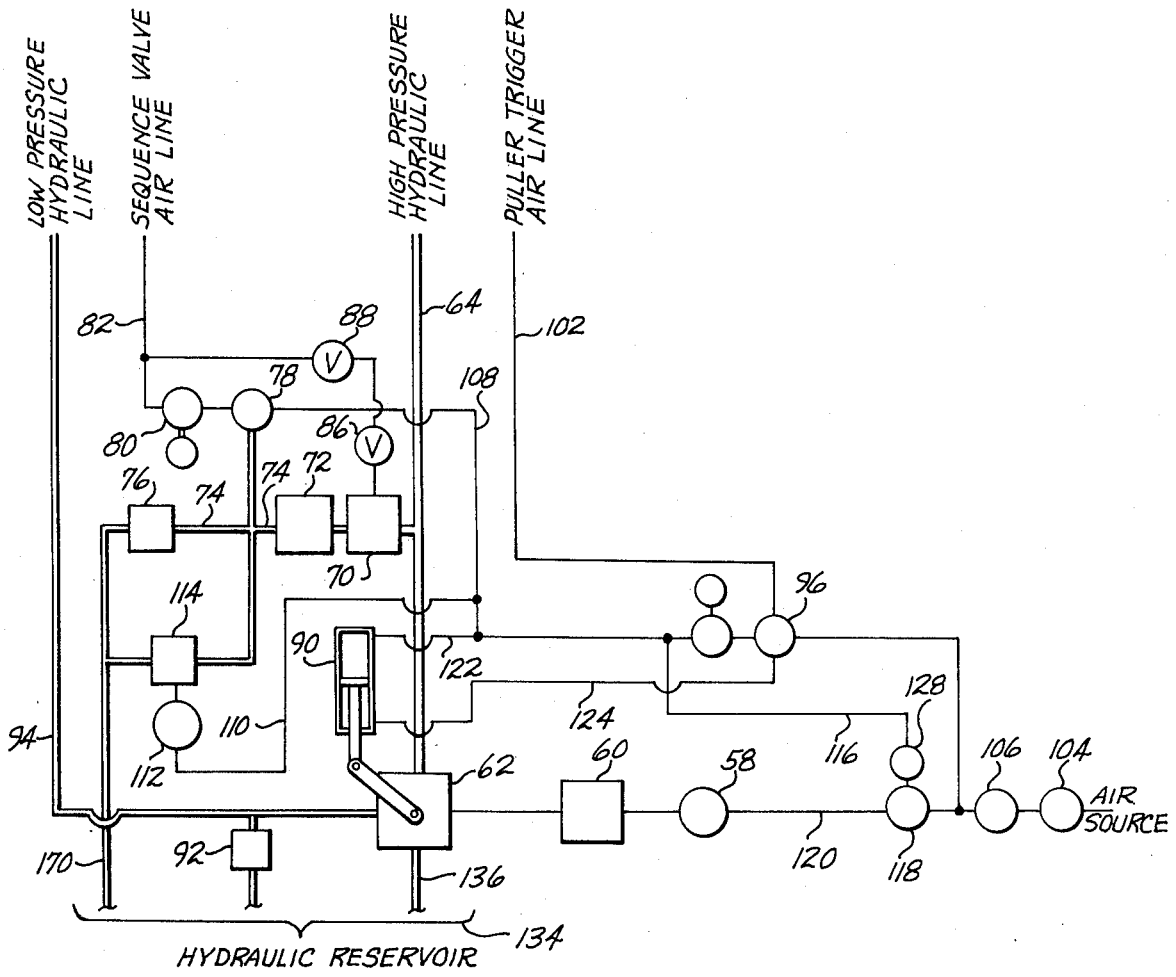
FIG. 6 shows a schematic of an air and hydraulic power and control system for the lockbolt setting apparatus.

A lockbolt setting device 10, has a pair of pistons 12 and 14 mounted within housing 16. An anvil or swaging die 18 is connected through holder 20 and hollow shaft 22 to piston 12. The anvil with piston are slideably mounted within the housing. A chuck collet 24, with collet extension 26, is fastened to piston 14 through hollow shaft 28. The chuck collet is slideably mounted to move within the structure of the anvil. The chuck or nose piece 30 with gripper jaws is mounted within the chuck collet. When the piston 14 moves the chuck collet the gripper jaws also are moved. A pair of follower caps 32 and 34 with spring 36 allow relative movement of the gripper jaws within the collet. The gripper jaws thus may move against the spring action and expand to allow entry of the pintail 38 of lockbolt 40. A standoff 42, part of the housing 16, allows a collar 44 be positioned on the lockbolt and the pintail to be pulled without exerting pressure on the collar. FIG. 3 shows a lockbolt with a positioned collar prior to seating the lockbolt, and FIG. 4 shows the lockbolt in the seated position. FIG. 5 shows the piston 12 has moved the anvil forward to swage the collar onto the seated lockbolt, and that piston 14 has moved to break off the pintail. Thus, the lockbolt has been swaged in a direction toward workpiece made up of parts 46 and 46*a*. End piece 48 in combination with collar 50 limits the forward travel of the piston 14. The interior of the lockbolt setting device is hollow 52 and the broken off pintails are directed through this hollow piece to come out the end 54 where they are further directed by guard 56. The unit is powered and sequenced with an air hydraulic system. Hydraulic pressure is generated by use of an air motor 58 which powers a hydraulic pump 60. Hydraulic fluid under pressure passes through 4-way control valve 62, through high pressure line 64, through inlet 66 and into the space 68 between pistons 12 and 14. Thus, this hydraulic fluid will move the pistons in opposite directions. Initially, piston 14 is moved to pull on the pintail and to seat the lockbolt.

During seating the hydraulic pressure builds up and is controlled by a pressure control system. An air operated shut-off valve 70, which is normally in the open position, directs fluid through pressure regulating valve 72 and into line 74. Pressure in this line builds up to a point determined by the setting on pressure relief valve 76. This pressure acts on hydraulic operated air check valve 78. When this valve is open it allows air to pass through quick exhaust valve 80 then into line 82. Air in this line accomplishes two purposes. One being to supply air to sequencing valve 84, and the other being to supply air through speed control valve 86 to shut off air operated hydraulic shut-off valve 70 to deactivate the pressure control system and allow the hydraulic pressure to build to full pressure. Under full pressure the anvil moves forward to swage the collar onto the lockbolt and to pull on the pintail to break off same.

Manual shut-off valve 88 is used to isolate the rest of the system while setting the hydraulic pressure regulator. This allows one to adjust the pull seating force for a specific size of lockbolt. Air operated cylinder 90 is used to control four-way valve 62 and thus determine the direction of flow of the hydraulic fluid. Pressure relief valve 92 is used to limit pressure in low pressure hydraulic line 94. Four-way air valve 96 is controlled by trigger 98 mounted in the handle 100 of the lockbolt setting device. An air line 102 leads from the four-way air control valve to the trigger and when the trigger is depressed bleeds air to actuate valve 96. When the air passes through filter 104 and lubricator 106 then through open valve 96, it introduces air to accomplish four purposes. One, air in line 108 feeds to hydraulic operated air check valve 78. Two, air passes through line 110, through speed control valve 112 and then operates air operated shut-off valve 114. Third, air passes through line 116 to pilot operated valve 118 thence through line 120 to air motor 58. Fourth, air passes through line 122 to air actuated cylinder 90 to open valve 62 and allow high pressure hydraulic fluid to enter line 64. When the trigger is released it actuates valve 96 to accomplish two things. One, it introduces air through line 124 to cylinder 90 which reverses hydraulic valve 62 to introduce low pressure hydraulic fluid into line 94. And two, pilot operated valve 118 is shut off which shuts off the air motor to the hydraulic pump and thus shuts off the hydraulic system. The shut off of valve 118 is accomplished by exhausting air in line 116 through valve 96. Shut off of the hydraulic system is delayed to permit reversing the hydraulic fluid to return hydraulic pistons 12 and 14 to their original position before the hydraulic system is shut off. This is accomplished by time delay valve 128 which delays the shut off of valve 118 by delaying the dumping of air from 118 through line 116.

When hydraulic fluid under pressure is introduced into the space 68 between pistons 12 and 14, movement of piston 14 causes hydraulic fluid to move through line 130 and into inlet 132 and directly through to line 94 thence back to the reservoir 134 through line 136. Flow of hydraulic fluid leading from piston 14 is free to move through sequencing valve 84 at all times. Movement of piston 12 causes hydraulic fluid to flow through line 138 then to inlet 140. The flow of this fluid is controlled by the sequencing valve. When the valve is in its normally closed position plunger 142 prevents passage of fluid from piston 12 by shutting off line 144. Downstream of the valve line 144 joins the direct through flow of fluid from line 146 in common line 94. An air operated piston 148 moves the valve plunger to permit flow through line 144. Springs 150 and 152 position the plunger in a normally closed position. Air leading from line 82 enters space 154 behind piston 148 to power the movement. A common line 156 extending between inlets 132 and 140 has a check valve with valve seat 158 and ball 160. This check valve prevents flow of fluid from the line leading from piston 12 but does permit flow in the opposite direction.

Figure 1:
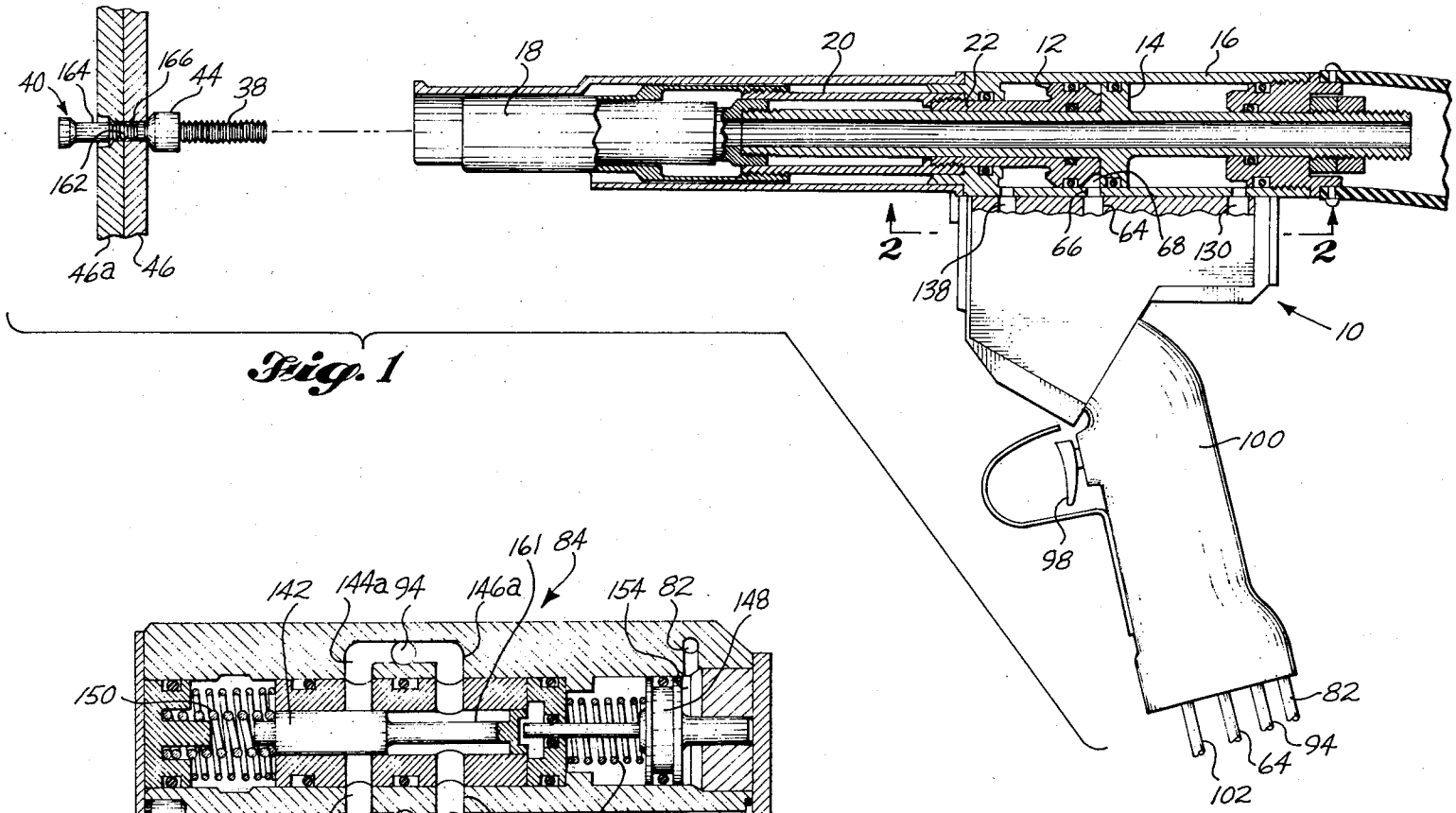
FIG. 1 shows a side elevation, partially in section, of a lockbolt positioned for seating and a lockbolt setting apparatus.
Figure 2:
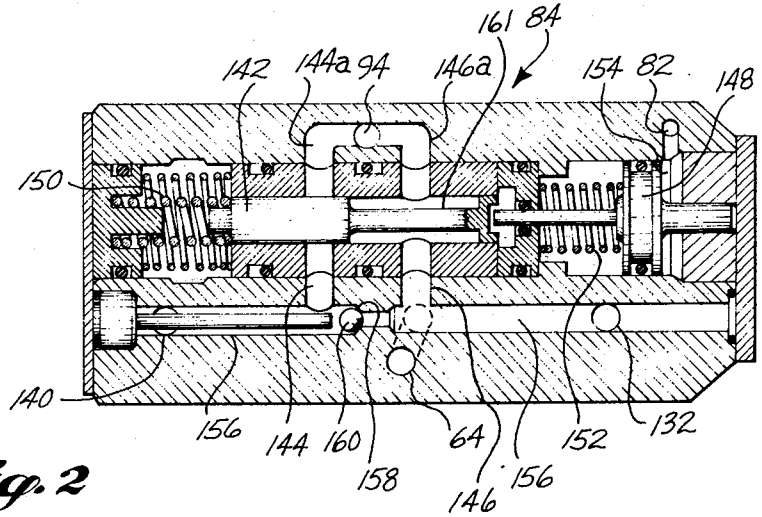
FIG. 2 shows a section of a sequencing valve taken along lines 2—2 of FIG. 1.

Alternatively, line 94 as shown in FIG. 2 could be located to extend from common line 156 on the inlet 132 side of the check valve, in which case the flow of fluid from piston 14 would by-pass the valve proper, the flow of fluid from piston 12 would flow along the reduced diameter 161 of plunger 142 when the sequencing valve is open, and part of lines 144 and 146 shown herein as 144a and 146a would not be required.

In operation, a lockbolt to be seated is positioned through a hole 162 in parts 46 and 46a to be fastened together. It is preferable to use a lockbolt with an interference fit. This lockbolt 40 has shank 164, serrations 166 into which the collar is to be forced and reduced diameter 168 to provide the break off. After the lockbolt is positioned in the fastener hole the collar is positioned on the lockbolt and the setting device positioned thereon. The threaded end 38 pushes against the jaws 30 which are moved away from the collet and spread to allow the jaws to grasp the threads. Spring action moves the jaws against the collet to wedge the jaws together to firmly hold the lockbolt. When hydraulic pressure is first introduced into high pressure line 64 it is limited by pressure regulating valve 72 to a pressure just high enough to seat the lockbolt. Once the lockbolt is seated pressure in line 74 builds up to a pressure set by pressure relief valve 76. This pressure is sufficient to activate valve 78 to close off the pressure limiting system and actuate the sequence valve.

When the device is being positioned the threads 38 on the pintail are grasped by the gripper jaws 30 and the stand off 42 prevents the collar 44 from having any force exerted thereon. The trigger 98 is held down to introduce air through 4-way air valve 96. This starts the air motor to drive the hydraulic pump, actuates four-way valve 62 to allow the introduction of hydraulic fluid under pressure into the space 68 between pistons 12 and 14. At this time sequencing valve 84 prevents flow of hydraulic fluid from cylinder 12 and thus holds swaging die 18 stationary. Movement of piston 14 pulls the collet against gripper jaws to pull the lockbolt into the seated position. Once the lockbolt is seated hydraulic pressure builds up in line 74 to actuate valve 78 to introduce air that shuts off air operated hydraulic shut-off valve 70 to allow full hydraulic pressure in line 64 and to introduce air to actuate piston 148 and thereby open the sequencing valve 84 to the flow of fluid from piston 12. This allows piston 12 to move forward and drive the anvil towards the working piece thereby swaging collar 44 into the serrations on the lockbolt. Once the anvil is bottomed against the workpiece the hydraulic pressure in line 64 builds up to move piston 14 with gripping jaws to break off the pintail. The trigger is released to reposition valve 96 and sends air pressure through line 124 to cylinder 90 and reposition four-way valve 62. This reverses the direction of flow of the hydraulic fluid out through line 94 then line 146 through the sequencing valve into common line 156. Fluid flows through line 130 to move piston 14 back toward the starting position until the end of disengagement sleeve 126 of the collet 24 reaches the swaged collar. Fluid also flows past the ball 160 of the check valve and enters line 138 to move piston 12 back to the starting position. This reaction of pistons 12 and 14 removes the anvil from the collar. Once the trigger is released the time delay device 128 delays the closing valve 118. The delay is timed to permit reversing the hydraulic fluid to return the hydraulic pistons to the original position and then shut off the hydraulic pump. This also removes air from speed control valve 112 which actuates air operated shut-off valve 114 to open said valve and allow hydraulic fluid in line 74 to drain through line 170 back to the hydraulic reservoir. As hydraulic pressure is relieved from line 74 it actuates hydraulic operated air check valve 78 to dump the air out of line 82. This permits springs 150 and 152 in sequencing valve 84 to move the piston and the valve plunger to shut off line 144, and permits speed control valve 86 to return air operated shut-off valve 70 to the normally open position.

We claim:

1. A lockbolt setting apparatus having a nose piece for grasping a pintail of a bolt and an anvil for swaging a collar to the bolt wherein the apparatus comprises: a housing having a stand off to provide clearance to the collar to permit seating a lockbolt without exerting pressure on the collar; a first piston connected to the anvil to provide sliding movement of the anvil within the housing; a second piston connected to the nose piece to provide sliding movement of the nose piece within the structure of the anvil; and means for sequencing and powering the apparatus to first, move the second piston to seat the bolt, second, to move the first piston in the opposite direction to swage the collar, third, to move the second piston an additional amount to break off the pintail of the bolt, and fourth, to move both pistons back to the original position.

2. A lockbolt setting apparatus as in claim 1 wherein the means for sequencing and powering the apparatus comprises: means for introducing hydraulic fluid under pressure to the inside of the housing and between the two pistons to move said pistons in opposite directions, means for preventing movement of piston 1 while piston 2 moves to pull the lockbolt into a seated position in a workpiece and for releasing piston 1 to permit said pistons to move forward with the anvil to swage the collar onto the seated bolt, and means for moving both pistons back to the starting position after the pintail has been broken off.

3. A lockbolt setting apparatus as in claim 2 wherein the means for preventing movement of piston 1 and for releasing piston 1 includes: a sequencing valve located in a hydraulic line leading from piston 1, said valve being air actuated to open at hydraulic pressures in excess of the pressure required to move piston 2 and seat the lockbolt.

4. A lockbolt setting apparatus as in claim 3 wherein the sequencing valve comprises: a first inlet to the valve leading from piston 2, and having a direct opening through the valve at all times, a second inlet to the valve leading from piston 1 and having a line extending through the valve to join a valve outlet line from piston 2 and controlled by valve action, a check valve located in a line common to the first and to the second inlet to prevent flow from the second inlet to the first inlet, and an air actuated piston located to control movement of the valve.

5. A lockbolt setting apparatus as in claim 3 wherein the sequencing valve comprises: a first inlet to the valve leading from piston 2 by-passing the valve proper, a second inlet to the valve leading from piston 1 extending through and controlled by the valve and having a valve outlet common to the valve outlet from the first inlet, a check valve located in a line common to the first and the second inlet to prevent flow from the second inlet to the first inlet, and an air actuated piston located to control movement of the valve.

6. A lockbolt setting apparatus as in claim 3 wherein the means for sequencing and powering the apparatus includes an air driven hydraulic pump system, means for introducing air to power the pump, means for introducing air to actuate the sequencing valve once hydraulic pressures in excess of the pressure required to seat the lockbolt has been reached, and means for reversing flow of hydraulic fluid to return the pistons to starting position and for shutting off the motor once the pintail has been broken.

7. A lockbolt setting apparatus having a nose piece for grasping a pintail of a bolt to seat the bolt and to break off the pintail and an anvil for swaging a collar to the seated bolt wherein the apparatus comprises: a stand off to a housing to permit seating a bolt with a collar in place, without exerting pressure on the collar; a pair of pistons within the housing, the first piston connected to actuate an anvil, and the second piston connected to actuate a nose piece; means for introducing hydraulic fluid under pressure between the two pistons to move said pistons in opposite directions; a sequencing valve located in an outlet hydraulic line from the first piston to prevent movement of said first piston until hydraulic pressure has been reached in excess of hydraulic pressure required to seat the lockbolt by movement of the second piston; and means for returning the pistons to the starting position once the seated lockbolt has been swaged and the pintail broken off.

8. A lockbolt setting apparatus as in claim 7 further comprising an air operated hydraulic valve to permit flow of hydraulic fluid into a pressure control system; a hydraulic operated air check valve to open when the hydraulic pressure exceeds the pressure required to seat the lockbolt, to direct air to operate the sequencing valve and to shut off the air operated hydraulic valve to allow full hydraulic pressure.

9. A lockbolt setting apparatus as in claim 8 wherein the sequencing valve comprises: a line from piston 2 bypassing the valve proper; a line from piston 1 extending through the valve, said line controlled by valve action joins the line from piston 2 downstream of the valve; a check valve in a line extending between inlets to the two lines, said check valve preventing movement of hydraulic fluid from outlet of piston 1 to outlet from piston 2; and an air cylinder to actuate the valve responsive to air directed by the hydraulic operated air check valve.

10. A lockbolt setting apparatus having puller jaws for fastening to a pintail of a lockbolt to pull the lockbolt into a seated position and to break off the pintail and a swage die for swaging a collar onto the seated lockbolt wherein the apparatus comprises: a stand off to a housing to permit seating a lockbolt with a collar in place and without exerting pressure on the collar, a first piston within the housing slideably connected to the swage die, a second piston slideably connected to puller jaws, means for introducing hydraulic fluid under pressure between the two pistons to move said pistons in opposite directions, a valve located in an outlet hydraulic line from the first piston, said valve normally closed to prevent movement of the first piston and having an air operated piston to actuate the valve, means for introducing air into the piston to open the valve and allow movement of the first piston to swage a collar onto a seated lockbolt when hydraulic pressure exceeds pressure required to move the second piston to seat the lockbolt, and a check valve located between outlets from the two hydraulic pistons to prevent flow of hydraulic fluid from the first piston to the hydraulic return line during the seating operation.

11. A method of setting lockbolts with the steps comprising: providing clearance for a collar positioned on a lockbolt; grasping a pintail of the lockbolt with puller jaws; introducing hydraulic fluid under pressure between a pair of pistons for moving the pistons in opposite directions and seating the lockbolt by movement of one of the pistons that is connected to the puller jaws; holding the other piston, connected to a swaging die, stationary until the lockbolt is seated; swaging the collar onto the seated lockbolt by advancing the swaging die; breaking off the pintail by further movement of the puller jaws; and returning both of the pistons to the starting position.

12. A method of setting lockbolts with the steps comprising: extending a housing on a setting apparatus to provide a stand off for allowing clearance to a collar on a a lockbolt, providing a pair of pistons within the housing for connecting to a swaging die from one piston and connecting to a gripping jaw from the other piston, introducing hydraulic fluid under pressure between the two pistons for moving the pistons in opposite directions, grasping the pintail of a lockbolt by the pulling jaws, sequencing movement of the pistons by first moving the pulling jaw piston to seat the lockbolt, moving the swaging die piston in the opposite direction to swage the collar onto the seated lockbolt, moving the pulling jaw piston to break off the pintail, and moving the pistons back to the starting position.

13. A method of setting lockbolts as in claim 12 wherein sequencing movements of the pistons comprise, preventing flow of hydraulic fluid from the swaging die piston until after seating the lockbolt, allowing flow of hydraulic fluid from the swaging die piston thus swaging the collar onto the seated lockbolt, and building up hydraulic pressure for breaking off the pintail when the swaging die bottoms out.

* * * * *